United States Patent [19]

Gerstner

[11] Patent Number: 4,475,602

[45] Date of Patent: Oct. 9, 1984

[54] ROLLER EQUIPPED EARTHWORKING MEMBER

[76] Inventor: Norman G. Gerstner, P.O. Box 2406, Soldatna, Ak. 99669

[21] Appl. No.: 436,574

[22] Filed: Dec. 23, 1982

[51] Int. Cl.[3] ..... E02F 9/28

[52] U.S. Cl. ..... 172/713; 172/699; 172/714; 172/718; 37/142 R; 414/785

[58] Field of Search ..... 172/714, 715, 716, 717, 172/718, 699, 672, 33, 747, 713, 752; 37/142 R, 141 T, 131, 129, 130, 142 A; 414/785, 607

[56] References Cited

U.S. PATENT DOCUMENTS

| | | | |
|---|---|---|---|
| 216,271 | 6/1879 | Harrington | 172/718 |
| 252,291 | 1/1882 | Estes | 172/718 |
| 2,498,504 | 2/1950 | Quayle | 414/785 |
| 2,549,088 | 4/1951 | Hettelsater | 172/747 |
| 3,392,858 | 7/1968 | Fernstrom | 414/785 X |
| 3,393,014 | 7/1968 | Ascher | 37/142 R |
| 3,549,035 | 12/1970 | Soper | 414/785 |
| 3,623,247 | 11/1971 | Stepe | 172/713 |
| 3,959,901 | 6/1976 | Klett | 172/713 |

FOREIGN PATENT DOCUMENTS

| | | | |
|---|---|---|---|
| 733531 | 5/1980 | U.S.S.R. | 172/714 |

*Primary Examiner*—Richard J. Johnson

*Attorney, Agent, or Firm*—James D. Givnan, Jr.

[57] ABSTRACT

An earth engaging instrumentality is equipped with wedge-like surfaces for displacement of earthen material. Rollers are rearwardly offset from the leading edge of the instrumentality and have chordal segments projecting outwardly beyond the diverging surfaces of the instrumentality to displace earthen material and hence facilitate penetration of same. An open, roller receiving area of the instrumentality is shown as being of a non-uniform width to receive upper and lower rollers of different widths which rollers may be of different peripheral configuration.

6 Claims, 8 Drawing Figures

ROLLER EQUIPPED EARTHWORKING MEMBER

BACKGROUND OF THE INVENTION

The present invention pertains generally to mobile earthworking equipment and particularly to a roller equipped ground insertable member carried thereby.

Heavy equipment used at various construction sites for moving earthen material typically is equipped with pointed teeth or shanks to facilitate dislodgment of the material being dealt with. Rocky subsoil presents particularly difficult penetration problems and results in rapid tooth and/or shank wear. Further, conventional teeth normally require a prime mover of considerable horsepower to effect penetration and breakup of hardearthen areas. As the earth penetrating member must be driven into the earthen material, the force required is directly proportional to surface friction encountered on the members' surfaces which typically are inclined to impart a wedging action. Tooth and shank maintenance costs constitute a significant cost to the machine operator by reason of frequent replacement or repair.

The closest known prior art to the present subject matter is toothe and shank structure disclosed in U.S. Pat. 3,393,014 issued July 16, 1968 to L. Ascher, Jr., which disclosure concerns an earth insertable tooth carried by an earthworking instrumentality with said tooth having roller means thereon disposed at the tooth leading edge. The patent disclosure is primarily directed toward the fracturing or scoring of pavement to form lines of fracture which subsequently serves to denote the boundary of the work area. A further objective of the patented structure is the scoring of paved road surfaces to assure fracturing thereof along a predetermined course to preclude pick and/or jackhammer work. The roller component is, as noted, located forwardly on the tooth or shank and accordingly is subjected to extreme loading were the tooth or shank to be driven into rocky subsoil in the manner of the present invention.

SUMMARY OF THE PRESENT INVENTION

The present invention is embodied within an earthworking member carried by a mobile prime mover which member includes roller means facilitating member penetration into hard earthen material.

When working in rocky ground, it is not uncommon to frequently replace or recondition the replaceable teeth and/or shanks of ground engaging equipment. It has been found presently advantageous to facilitate penetration of the instrumentality or member by the incorporation of roller means having a chordal portion exposed for movable contact with the material being worked. Such a roller arrangement contributes to fracturing said material and hence lessen the force required for penetration. A preferred form of the invention embodies multiple rollers each having a chordal portion protruding beyond an adjacent surface of the tooth, shank, etc., carried by the prime mover. A cavity in the earthworking member receives the roller or rollers in a manner preventing the entry of rock fragments or the like to prevent jamming of same. Loads borne by the roller means are transferred to roller spindles carried by the earthworking member. The rollers may have various configurations to enable selection of that configuration best suited to the material being worked. For example, roller width may vary and the surface provided with replaceable carbide inserts. Additionally, when the rollers are utilized in pairs, the external configuration of each roller may vary from the remaining roller of the pair.

Important objectives include the provision of an earthworking instrumentality, such as a shank mounted tooth or a ripper foot within which are rotatably mounted rollers so as to have exposed chordal segments of same protruding from adjacent surfaces to engage and displace earthen material; the provision of an earthworking instrumentality defining an open area within which are rotatably mounted multiple rollers engageable with earthen material to facilitate penetration of the instrumentality and hence permit a reduction in the horsepower requirement of the prime mover; the provision of an earthworking instrumentality having detachable roller means of different configurations held in place by a removable spindle.

DETAILED DESCRIPTION OF THE PREFERRED EMBODIMENTS

Figures 1, 2, 3, 4, 5, 6, 7, 8:
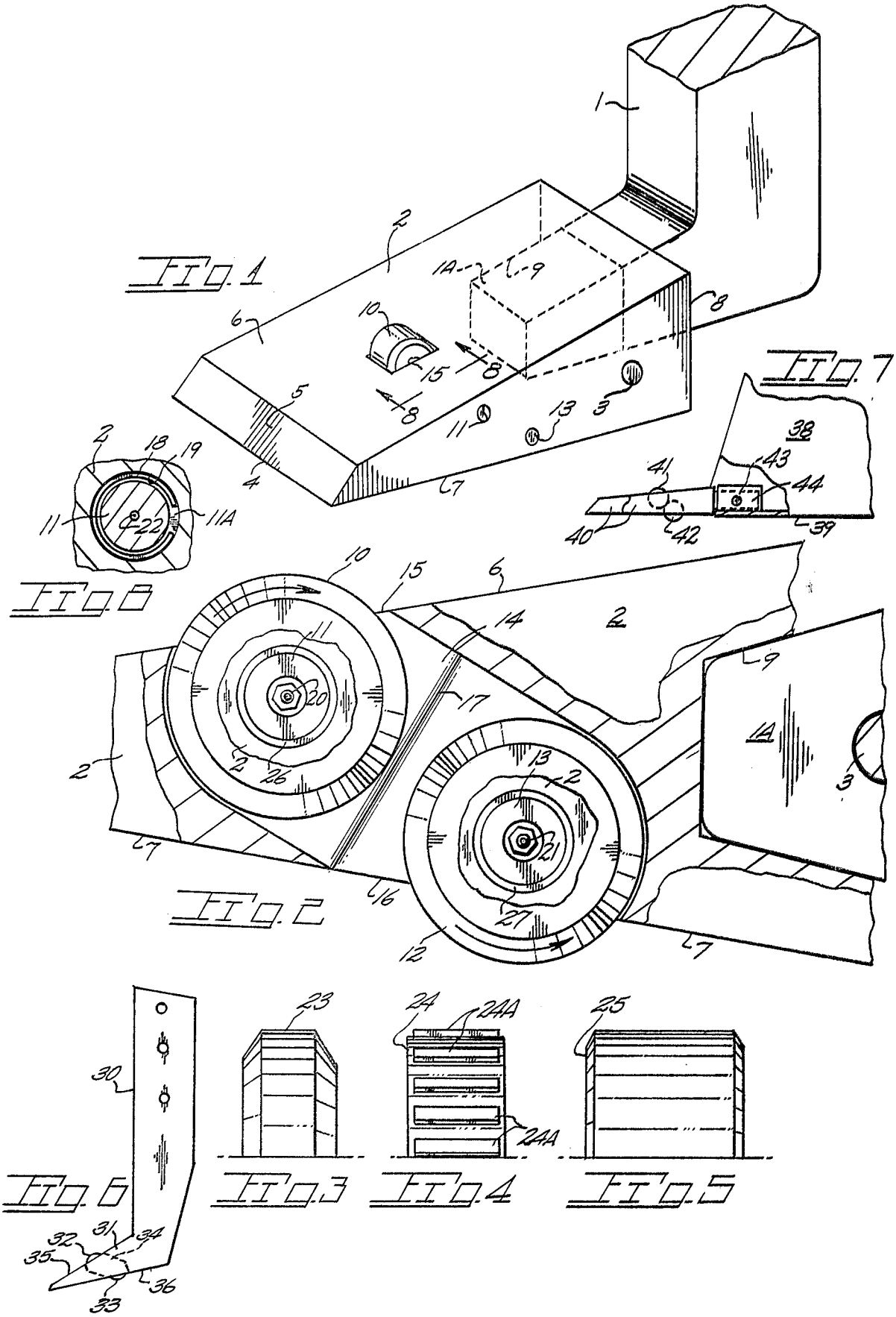
FIG. 1 is a perspective view of a tooth embodying the present invention in place on a shank fragment.
FIG. 2 is an enlarged side elevational view of the fragmentary tooth with parts broken away for purposes of illustration.
FIGS. 3 through 5 are elevational sectional view of various roller configurations broken away along their respective centerlines.
FIG. 6 is a side elevational view of an earthworking shank having a foot portion equipped in accordance with the present invention.
FIG. 7 is a fragmentary view of a loader bucket having teeth modified in accordance with the present invention.
FIG. 8 is a vertical sectional view taken along line 8—8 in FIG. 1 and showing a band type ring holding a roller spindle in place within a tooth bore .

With continuing attention to the drawing wherein applied reference numerals indicate parts similarly identified in the following description, the reference numeral 1 indicates a shank component carried by a piece of earthworking equipment, such as for example a tractor-mounted ripper shank. The shank is in inserted engagement with a removably mounted tooth body 2 constituting an earthworking member. A pin 3 passes through the tooth body and through an inserted end 1A of the shank for tooth mounting purposes. Such an arrangement is intended to be more or less typical of known tooth-shank combinations.

A tooth leading edge at 4 has a beveled surface at 5 with upper and lower tooth surfaces 6 and 7 diverging rearwardly and terminating at a tooth rear wall 8. A recess 9 extends forwardly from said rear wall and within which is nested the forward end 1A of shank 1. Accordingly, tooth body 2 is securely mounted on the shank with tooth loads being transferred to the shank along abutting tooth and shank surfaces.

A roller 10 is rotatably mounted within the tooth body by a fixedly mounted spindle 11 while similarly a fixedly mounted second roller at 12 is supported in place by a spindle 13. The foregoing roller means are located within a tooth open area 14 terminating upwardly in an opening 15 in upper surface 6 of the tooth. A second opening at 16 is defined by tooth lower surface 7. Said open area may be of uniform width but in a preferred embodiment of the invention the area is of a greater width adjacent lower opening 16 to permit roller 12 to have a greater width or transverse dimension than roller 10. A shoulder 17 denotes a boundary between the different area widths.

As viewed in FIG. 1, tooth opening 15 is of a configuration and size so as to have its perimeter proximate the sides and peripheral surface of roller 10 to prevent entry of the earthen material. Removal of spindle 11 from the tooth permits roller 10 to be removed from the tooth downwardly through area 14 which is also the case for roller 12. Roller rotation during earth penetration will normally be in the direction indicated by the applied arrows. Accordingly, the counterclockwise rotation of roller 12 will deter the entry of earthen fragments into the recesses.

As shown in FIG. 8, the roller spindles may have an annular recess as at llA to receive a steel band type ring 18 which is in biased contact with a tooth bore 19 to prevent axial movement of the spindle. Insertion and removal of the spindle and ring 18 is by a pressing operation. Recessed lubrication fittings at 20 and 21 admit lubrication to spindle bores as at 22 which have communicating radial passageways for lubricant flow to the spindle periphery. Bushings are at 26 and 27.

An array of roller configurations at 23, 24 and 25 is shown in FIGS. 3 through 5. Roller 24 is provided with inset carbide inserts as at 24A spaced apart about its grooved periphery. Periodic replacement of the inserts may be accomplished as by securing same in place with silver solder. Roller 25 in FIG. 5 is of greater width than the rollers shown in FIGS. 3 and 4 and is intended for use as a roller associated with the lowermost surface 7 of a tooth or shank. The increased peripheral surface of roller 25 provides an increased load bearing area.

The term earth and earthen material is presently intended to encompass both naturally occurring ground formations as well as "manmade" material.

In FIG. 6 I show a shank 30 adapted for pinned attachment to a prime mover with the shank having a forwardly projecting foot body at 31 equipped with roller means at 32 and 33. The roller means is received within an open area 34 of the foot body in the manner above described for tooth body 2 with diverging foot body surfaces at 35 and 36.

With attention to FIG. 7 a loader carried bucket at 38 has a bottom wall 39 on which tooth bodies such as at 40 are carried in a spaced apart manner. The tooth bodies may have the same general configuration as the tooth body earlier described to mount upper and lower rollers at 41 and 42. A rearwardly extending tooth body extension at 43 is removably secured in place within a socket 44 as by pinned engagement.

While I have shown but a few embodiments of the invention it will be apparent to those skilled in the art that the invention may be embodied still otherwise without departing from the spirit and scope of the invention.

Having thus described the invention, what is desired to be secured under a Letters Patent is:

I claim:

1. An earthworking member for attachment to a prime mover, said earthworking member including, a body having a horizontal leading edge for earthen material penetration, upper and lower surfaces rearwardly diverging from said leading edge, a rear wall, said body defining an open area rearwardly offset from said leading edge, said body also defining a forwardly extending recess terminating rearwardly at said rear wall, said recess adapted to receive the end of a prime mover mounted shank, and roller means horizontally disposed within said open area including a roller having a chordal segment extending beyond one of said surfaces to dislodge material to facilitate insertion of the body into earthen material.

2. The earthworking member claimed in claim 1 wherein said roller means includes multiple rollers on spindles with fixed axes with one roller having a chordal segment at all times extending above the upper surface and a second roller having a chordal segment at all times extending below the lower surface.

3. The earthworking member claimed in claim 2 wherein said body defined open area is of non-uniform width, said roller means comprising rollers of unlike widths.

4. The earthworking member claimed in claim 3 wherein the roller of greatest width has a chordal portion extending below the lower surface of said body.

5. The earthworking member claimed in claim 1 wherein said roller means has wear resistant carbide inserts parallel to the roller axis.

6. The earthworking member claimed in claim 2 wherein the roller axes are common to vertical planes offset from one another.

* * * * *